US006688765B2

(12) United States Patent
Matoge

(10) Patent No.: US 6,688,765 B2
(45) Date of Patent: Feb. 10, 2004

(54) CLUTCH WHEEL FOR A TIMEPIECE

(75) Inventor: Akihiro Matoge, Chiba (JP)

(73) Assignee: Seiko Instruments Inc., Chiba (JP)

( * ) Notice: Subject to any disclaimer, the term of this patent is extended or adjusted under 35 U.S.C. 154(b) by 258 days.

(21) Appl. No.: 09/814,518

(22) Filed: Mar. 22, 2001

(65) Prior Publication Data

US 2001/0026501 A1 Oct. 4, 2001

(30) Foreign Application Priority Data

Mar. 31, 2000 (JP) ..... 2000-098571

(51) Int. Cl.[7] ..... G04B 19/100
(52) U.S. Cl. ..... 368/191; 368/76
(58) Field of Search ..... 368/21, 191–194, 368/184, 185, 319–321, 216, 49, 76; 29/274

(56) References Cited

U.S. PATENT DOCUMENTS

| | | | | | |
|---|---|---|---|---|---|
| 328,307 | A | * | 10/1885 | Hart | 368/216 |
| 3,318,085 | A | * | 5/1967 | Lee | 368/191 |
| 3,785,141 | A | * | 1/1974 | Ikegami | 368/21 |
| 3,930,362 | A | * | 1/1976 | Cielaszyk | 368/185 |
| 4,382,689 | A | * | 5/1983 | Voland | 368/191 |
| 4,396,294 | A | * | 8/1983 | Yoshida | 368/191 |
| 5,867,454 | A | * | 2/1999 | Takahashi et al. | 368/148 |

FOREIGN PATENT DOCUMENTS

| | | |
|---|---|---|
| CH | 39169 | 2/1908 |
| CH | 82805 | 10/1919 |
| CH | 139869 | 5/1930 |
| CH | 249415 | 6/1947 |
| CH | 281488 | 3/1952 |
| DE | 8000231 | 6/1980 |

* cited by examiner

*Primary Examiner*—David Martin
*Assistant Examiner*—Jeanne-Marguerite Goodwin
(74) *Attorney, Agent, or Firm*—Adams & Wilks

(57) ABSTRACT

A clutch wheel for a timepiece includes a cylindrical portion having an inner peripheral surface for slidably receiving an indicator hand setting stem of the timepiece, an outer peripheral surface, and a flanged base surface. A plurality of teeth are formed on an upper surface of the flanged base surface surrounding the outer peripheral surface of the cylindrical portion. The teeth may be in contact with or spaced from the outer peripheral surface of the cylindrical portion, and the clutch wheel may be forged of metal.

16 Claims, 3 Drawing Sheets

CLUTCH WHEEL FOR A TIMEPIECE

BACKGROUND OF THE INVENTION

1. Field of the Invention

The present invention relates to a clutch wheel for a timepiece.

2. Description of the prior Art

The conventional clutch wheel manufactured by machining a metal is formed, as shown in FIG. 4, with a cylindrical portion 50 in a center and a plurality of clutch teeth 51 radially provided from an outer surface of the cylindrical portion 50. The cylindrical portion is provided, in an inner peripheral surface, with a convex portion 52 and a concave portion 53 and formed such that a hand setting stem (not-shown) having convex and concave portions in an outer peripheral surface penetrates axially slidable and relatively non-rotatable. In particular, an opening defined by the inner peripheral surface of the cylindrical portion has a surface matching an outer peripheral surface of the hand setting stem of the timepiece so that the two rotate as a unit.

In a state the hand setting stem is drawn out by one stage, a wheel train is corrected for rotation angle (hand-rotation correction). That is, in the state the hand setting stem is drawn by one stage, a hand-setting-stem convex-and-concave portion and a convex-and-concave portion of the clutch wheel become engaged so that the clutch wheel rotates along with rotation of the hand setting stem. The clutch wheel is formed with a plurality of clutch teeth to mesh with setting teeth of the setting wheel to deliver rotational motion to the setting wheel. The rotating setting wheel performs hand-rotation correction through the wheel train. In hand-rotation correction, gears are generally meshed in the order of the clutch wheel→the setting wheel→a minute gear→a minute indicator wheel mounting a slip mechanism, a minute pinion→hour indicator wheel, thereby performing hand-rotation correction.

The conventional clutch wheel as above has the following problems:

(1) If hand-rotation correction as described above is repeatedly performed, the clutch wheel manufactured by machining a metal has a load concentration at a base end of the clutch teeth, and clutch teeth become broken and the wheel goes out of engagement with the setting wheel, disabling hand-rotation correction.

Meanwhile, if the clutch tooth base is increased in thickness, the strength improves but the spacing between the teeth become narrow. Accordingly, the clearance with the setting wheel decreases thereby stretching the clutch tooth and the setting tooth against one another and improper meshing.

(2) Because there is in the under no receiving surface upon being forged, manufacture is only by machining resulting in expensive cost.

It is a first object of the present invention to eliminate the above problems of the prior art and provide a clutch wheel that has a clutch teeth high in strength and less liable to be broken and is inexpensive in manufacture cost.

It is a second object of the invention to provide a timepiece clutch that has clutch teeth having a strength equivalent to or higher than the conventional clutch but cheap in manufacture cost.

SUMMARY OF THE INVENTION

In accordance first with a aspect of the present invention for solving the first problem described above is a clutch wheel for a timepiece formed of a metal, and comprising a cylindrical portion in which a hand setting stem penetrates slidably and relatively non-rotatably, a flange portion integrally formed with a base end of the cylindrical portion, a plurality of teeth integrally formed on a side surface of the flange portion and radially formed in a manner surrounding the cylindrical portion from an outer peripheral surface of the cylindrical portion.

A second aspect of the invention for serving the second problem described above is a clutch wheel for a timepiece formed of a metal, and comprising a cylindrical portion in which a hand setting stem penetrates slidably and relatively non-rotatably, a flange portion integrally formed with a base end of the cylindrical portion, a plurality of individual teeth integrally formed on a side surface of the flange portion and radially formed in a manner surrounding the cylindrical portion spaced from an outer peripheral surface of the cylindrical portion.

A third aspect of the present invention for solving the second problem described above is a clutch wheel for a timepiece in which the individual teeth have a cylindrical shape.

(Operation)

If forming as in the first form, even if hand-rotation correction is repeatedly performed, the load is distributed not only in a base of the clutch teeth at the outer peripheral surface of the cylindrical portion but also in a base of the clutch teeth to the flange side surface, making breaking less likely to occur. Also, because forging, die may include a type separated into two parts in an upper level of the flange due to the provision of the flange portion, it is possible to manufacture by forging a metal and to thereby reduce manufacture cost and lead time as compared to those associated with clutches manufactured by machining.

Furthermore, because of provision of the flange integrally formed with the base end of the cylindrical portion, the strength of the entire clutch wheel including the clutch teeth improves.

If the clutch wheel is structured as in the second or the third aspects, manufacture by forging is made possible as mentioned before and manufacture cost can be reduced.

Furthermore, because the flange portion is provided that is integrally formed with the base end of the cylindrical portion, the strength of the entire clutch wheel improves with the strength of the clutch teeth kept equal to or higher than the conventional.

BRIEF DESICRIPTION OF THE DRAWINGS

A preferred form of the present invention is illustrated in the accompanying drawings in which.

DETAILED DESCRIPTION OF THE PREFERRED EMBODIMENTS

Although one embodiment of the present invention will be explained below, the invention is not limited to this.

Figure 1A:
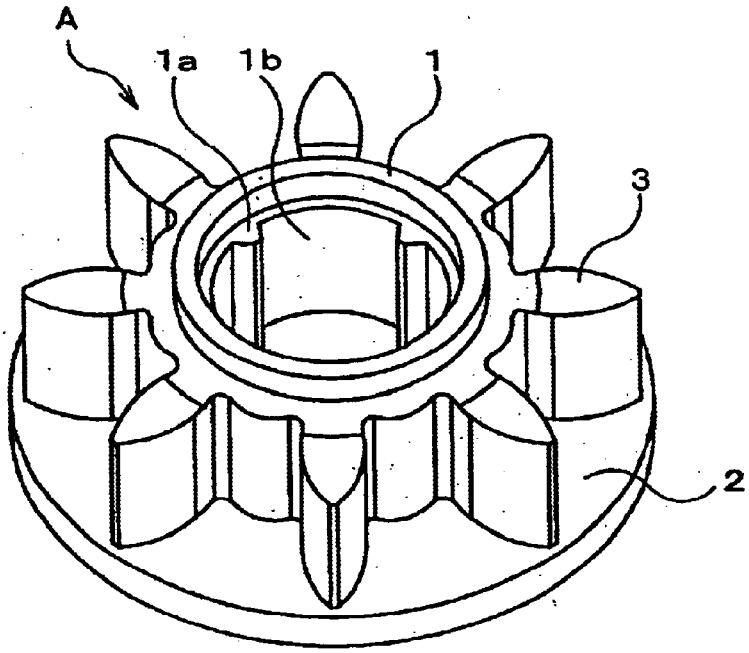
FIGS. 1A and 1B are perspective views showing a structure of a first embodiment of a clutch wheel of the present invention.
Figure 1B:
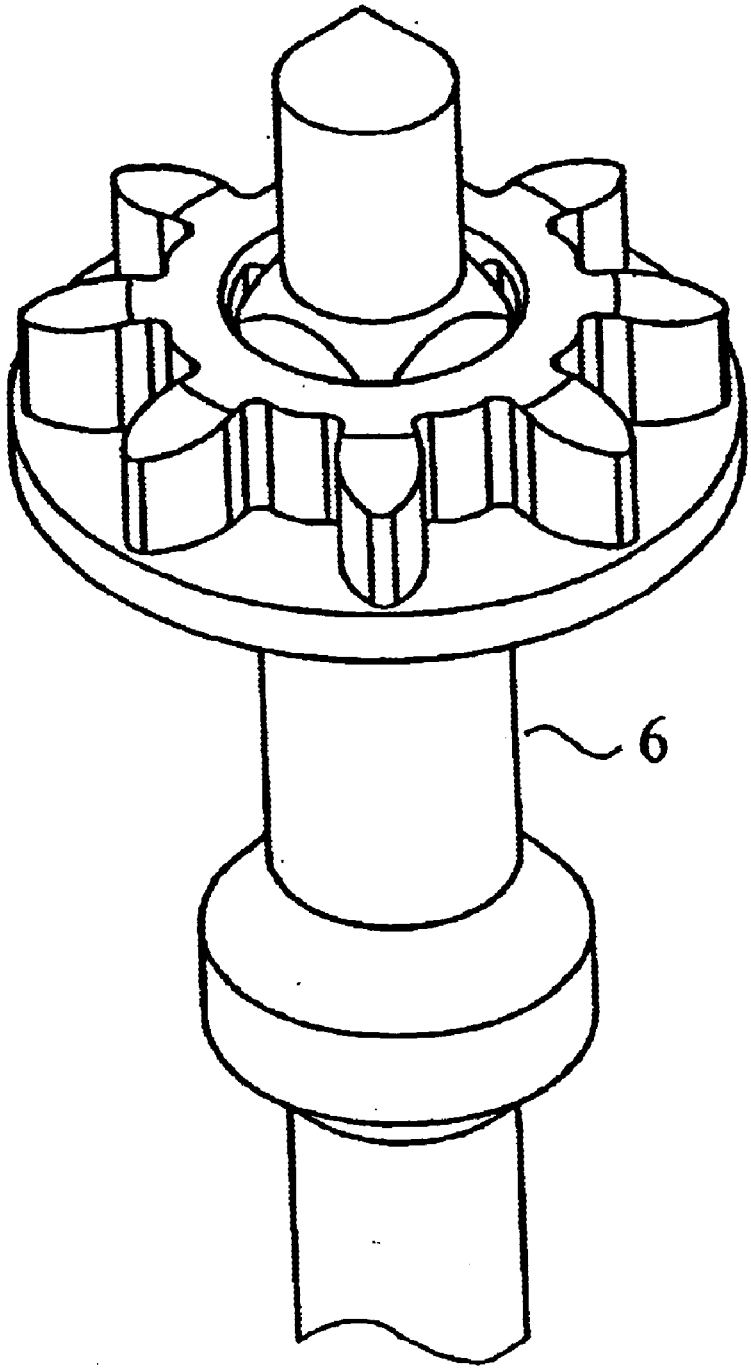

FIGS. 1A and 1B are perspective views showing a structure of one embodiment of a clutch wheel of a timepiece of the invention.

A clutch wheel A of a timepiece of the present embodiment is made of metal. The principal part is structured by a cylindrical portion 1 through which a hand setting stem 6 penetrates slidably and relatively non-rotatably, a flange portion 2 formed integral with a base end of the cylindrical portion 1, and a plurality of teeth 3 formed integral with a lateral surface of the flange portion 2 and formed in a radial form surrounding the cylindrical portion 1 from an outer peripheral surface of the cylindrical portion 1.

In an inner periphery of the cylindrical portion 1, convex portions 1*a* and concave portions 1*b* are alternately regularly formed to be slidably and relatively non-rotatably engaged with a not-shown hand setting stem formed in cross section matched to the inner-periphery sectional shape.

Next, a second embodiment of a clutch wheel of a timepiece of the invention will be explained with reference to the attached drawings.

Figure 2:
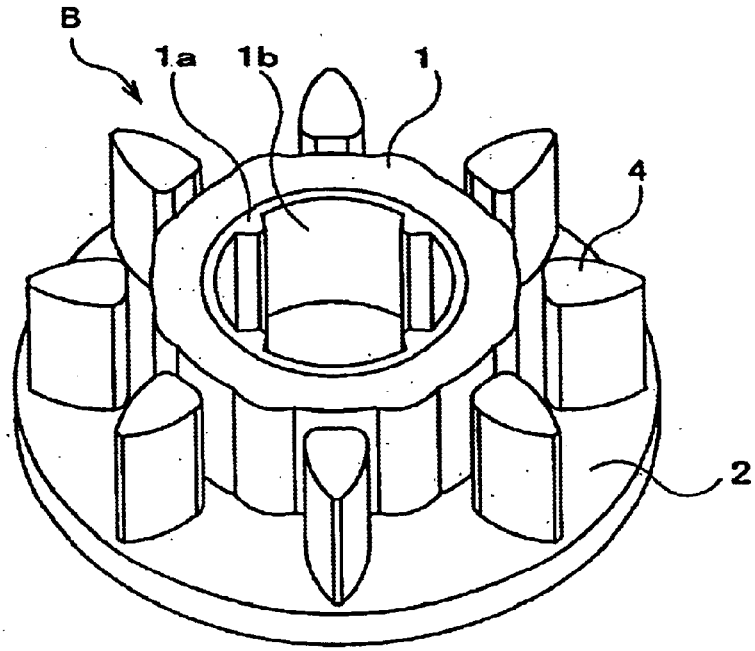
FIG. 2 is a perspective view showing a structure of a second embodiment of a clutch wheel of the invention.

FIG. 2 is a perspective view of a second embodiment of a clutch wheel of a timepiece of the invention.

A clutch wheel B of a timepiece of the present embodiment is made of metal. The principal part is structured by a cylindrical portion 1 through which a not-shown hand setting stem penetrates slidably and relatively non-rotatably, a flange portion 2 formed integral with a base end of the cylindrical portion 1, and a plurality of dependent teeth 4 formed integral with a lateral surface of the flange portion 2 and formed in a radial form surrounding the cylindrical portion 1 spaced from an outer peripheral surface of the cylindrical portion 1.

Incidentally, in an inner periphery of the cylindrical portion 1, convex portions 1*a* and concave portions 1*b* are alternately regularly formed to be slidably and relatively non-rotatably engaged with a not-shown hand setting stem formed in cross section matched to the inner-periphery sectional shape, which is the same as the above first embodiment.

Next, a third embodiment of a clutch wheel of a timepiece of the invention will be explained with reference to the attached drawings.

Figure 3:
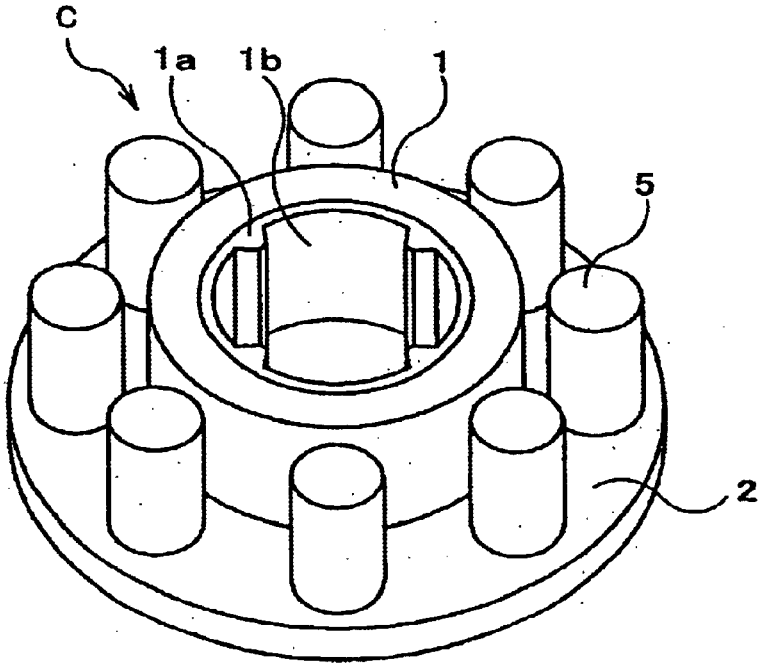
FIG. 3 is a perspective view showing a structure of a third embodiment of a clutch wheel of the invention.
Figure 4:
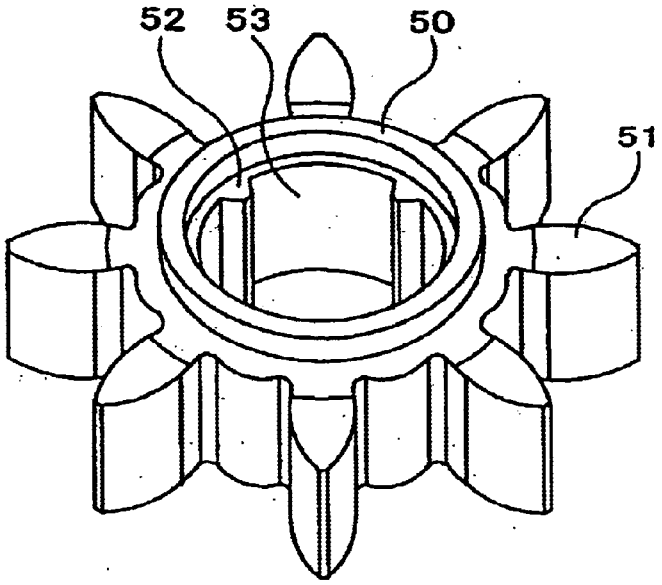
FIG. 4 PRIOR ART
FIG. 4 is a perspective view showing a structural example of a conventional clutch wheel.

FIG. 3 is a perspective view of a third embodiment of a clutch wheel of a timepiece of the invention.

A clutch wheel C of the present embodiment is the same as the second embodiment except for the following point. That is, the individual tooth of the second embodiment was in a cross sectional form of a flower-leaf form whereas the individual tooth of the present embodiment is in a circular cross sectional shape forming a cylindrical individual tooth.

The present embodiment thus structured is simple in clutch teeth form and easy to forge as compared to the first and second embodiment, correspondingly reducing cost.

The present invention provides the following excellent effects.

(1) The clutch teeth are improved in strength and less liable to be broken as compared to the conventional machined metal clutch wheel. Because of forgeability, the clutch wheel is shortened in manufacture lead time and reduced in manufacture cost.

(2) The clutch tooth has a strength equivalent to or higher than that of the conventional machined clutch. Because of the forge ability of the inventive clutch wheel, the clutch wheel is shortened in manufacture lead time and reduced in manufacture cost.

What is claimed is:

1. A clutch wheel for a timepiece, comprising:

a cylindrical portion having an opening for slidably receiving a hand setting stem of the timepiece;

a flange portion integrally formed with a base end of the cylindrical portion and extending radially outward therefrom; and a plurality of teeth adjacent to and surrounding an outer peripheral surface of the cylindrical portion, the teeth being integrally formed on an upper surface of the flange portion to expend upwardly from the flange portion and radially outward of the outer peripheral surface of the cylindrical portion;

wherein the clutch wheel is formed of a metal.

2. A clutch wheel for a timepiece according to claim 1; wherein the teeth have a circular cross-sectional shape.

3. A clutch wheel for a timepiece according to claim 1; wherein the opening in the cylindrical portion has a surface matching an outer peripheral surface of the hand setting stem of the timepiece so that the two rotate as a unit.

4. A clutch wheel for a timepiece according to claim 1; wherein the cylindrical portion, the flange portion and the teeth are forged of metal.

5. A clutch wheel for a timepiece according to claim 1; wherein the cylindrical portion, the flanged base surface and the teeth are forged of metal.

6. A clutch wheel for a timepiece according to claim 1; wherein the cylindrical portion and the teeth are comprised of metal.

7. A clutch wheel for a timepiece, comprising:

a cylindrical portion having an opening for slidably receiving a hand setting stem of the timepiece;

a flange portion integrally formed with a base end of the cylindrical portion and extending radially outward therefrom; and a plurality of individual teeth adjacent to and surrounding an outer peripheral surface of the cylindrical portion, the teeth being integrally formed on an upper surface of the flange portion to extend upwardly from the flange portion and radially outward of the outer peripheral surface of the cylindrical portion and being spaced from the outer peripheral surface of the cylindrical portion;

wherein the clutch wheel is formed of a metal.

8. A clutch wheel for a timepiece according to claim 7; wherein the teeth have a cylindrical shape.

9. A clutch wheel for a timepiece according to claim 7; wherein the teeth have a circular cross-sectional shape.

10. A clutch wheel for a timepiece according to claim 7; wherein the opening in the cylindrical portion has a surface matching an outer peripheral surface of the hand setting stem of the timepiece so that the two rotate as a unit.

11. A clutch wheel for a timepiece according to claim 7; wherein the cylindrical portion, the flange portion and the teeth are forged of metal.

12. A clutch wheel for a timepiece, comprising: a cylindrical portion having an inner peripheral surface for slidably receiving an indicator hand setting stem of the timepiece, an outer peripheral surface, and a flanged base surface extending radially outward of the outer peripheral surface of the flanged base surface to extend upward of the flanged base surface and surround the outer peripheral surface of the cylindrical portion.

13. A clutch wheel for a timepiece according to claim 12; wherein the teeth are spaced from the outer peripheral surface of the cylindrical portion.

14. A clutch wheel for a timepiece according to claim 12; wherein the teeth have a cylindrical shape.

15. A clutch wheel for a timepiece according to claim 12; wherein the teeth have a circular cross-sectional shape.

16. A clutch wheel for a timepiece according to claim 12; wherein the opening in the cylindrical portion has a surface matching an outer peripheral surface of the hand setting stem of the timepiece so that the two rotate as a unit.

* * * * *